US006302019B1

(12) United States Patent
Palmatier et al.

(10) Patent No.: US 6,302,019 B1
(45) **Date of Patent: *Oct. 16, 2001**

(54) APPARATUS AND METHOD FOR ADJUSTING SKEW IN A PRINTING PRESS DAMPENER

(75) Inventors: Roland Thomas Palmatier, Durham; Clifford Allen Zabkar, Dover; Brian Robert Elkinson, Rochester; David Charles Burke, Portsmouth, all of NH (US)

(73) Assignee: Heidelberger Druckmaschinen AG, Heidelberg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/121,428

(22) Filed: Jul. 23, 1998

(51) Int. Cl.[7] ..... B41L 23/04

(52) U.S. Cl. ..... 101/148; 101/247; 101/218; 101/352.04

(58) Field of Search ..... 101/148, 247, 101/248, 218, 220, 221, 222, 352.01, 352.02, 352.03, 352.04

(56) References Cited

U.S. PATENT DOCUMENTS

| | | | | |
|---|---|---|---|---|
| 2,570,242 | | 5/1947 | James | 101/145 |
| 4,301,728 | * | 11/1981 | Jaffe et al. | 101/247 |
| 4,369,705 | * | 1/1983 | Gelina | 101/247 |
| 4,458,590 | * | 7/1984 | Egnaczak et al. | 101/247 |

FOREIGN PATENT DOCUMENTS

| | | |
|---|---|---|
| 0 105 477 | 4/1984 | (EP) . |
| 1 278 881 | 6/1972 | (GB) . |
| 2 038 243 | 7/1980 | (GB) . |
| 2 212 106 | 7/1989 | (GB) . |

OTHER PUBLICATIONS

Arthur Hilner, "Diagonal oder ähnliches...," Deutscher Drucker, Bd. 24, No.11, Apr. 7, 1988, p. 15.

* cited by examiner

*Primary Examiner*—Christopher A. Bennett
(74) *Attorney, Agent, or Firm*—Kenyon & Kenyon

(57) ABSTRACT

A method and apparatus for adjusting skew settings in a dampener in a printing press. One or more skew adjustment linkages connect skew adjustment rods for the upper and lower dampeners of each printing unit. The linkage ensures that a single movement by the operator will allow adjustment of the skewing of both the upper and lower dampeners at the same time. The linkage or linkages are preferably connected at one end to skew adjustment brackets, which in turn are connected to a skew adjustment rod for one of the upper or lower dampeners. The skew adjustment rod adjusts the amount of skew of associated pan rolls. Movement of the linkage may be controlled by movement of a spring plunger, which is connected to the linkage or linkages. The spring plunger may be spring biased, and may be adjusted and locked into different skew setting positions using a pinhole arrangement. A web width indicator associated with the spring plunger may be used to guide the operator to an appropriate skew setting for a particular web width. The skew adjustment rod may also include a fine tuning mechanism, used to make minor adjustments to the skew settings for the dampeners, for example, when a particular setting is between one of the settings established by the pin-hole arrangement.

14 Claims, 8 Drawing Sheets

APPARATUS AND METHOD FOR ADJUSTING SKEW IN A PRINTING PRESS DAMPENER

BACKGROUND OF THE INVENTION

1. Field of the Invention

The present invention relates to dampeners used in printing presses. In particular, the present invention relates to skewing mechanisms used with dampeners in a web-fed offset printing press.

2. Description of the Prior Art

Prior art web-fed offset printing presses have included dampeners which are used to provide, and adjust, an amount of water, which is mixed with a fountain solution, onto the web being printed. Examples of upper UD and lower LD dampeners used in a prior art web-fed offset printing press unit P are shown schematically in FIG. 1. The dampeners UD and LD transfer water to upper plate UP and lower plate LP, respectively, which in turn transfer water to opposite sides of the web W being printed. The upper and lower plates UP, LP transfer an inked image to upper and lower blankets UB, LB, which transfer the inked image to opposite sides of a web W.

Webs having different widths will require different amounts of water be transferred to the web surface during printing. It is known in the art that skewing a skew or pan roll relative to an adjacent slip roll in a dampener can be used to regulate the amount of water which is transferred from a dampener pan to the web. This skewing, therefore may be used to adjust the dampener so that the proper amount of water is supplied to a web of a particular width. If a skew adjustment is not made upon the change in width of the web, it is possible that an inappropriate amount of water will be delivered to the middle section of the web versus the edges, which can result in poor-quality printing or web breakage.

FIGS. 2*a* and 2*b* show the upper dampener UD and/or lower dampener LD of FIG. 1 having two different positions of an end of skew or pan roll PN relative to slip roll SL. In FIG. 2*a,* one end of the skew or pan roll PN is in a first position A relative to slip roll SL, while in FIG. 2*b,* one end of the skew or pan roll PN is in a second position B relative to slip roll SL. In the prior art device of FIGS. 1, 2*a* and 2*b,* an end of the skew or pan roll PN can have an infinite number of positions relative to the slip roll SL, because those positions are adjusted using a skew adjustment rod RS described below. As is known in the art, a dampening agent D, preferably water (with a fountain solution), is conveyed from a pan P by rotation of skew or pan roll PN. Slip roll SL transfers the dampening agent D, from skew or pan roll PN to vibrator roll DV, then to form roll DF and then to the plate UP or LP.

The steps used to make a skew adjustment for a prior art lower dampener LD are shown in FIGS. 3*a*–3*d.* In a first step, a wrench R is used to loosen a skew mechanism lock nut (not shown), by rotation in a direction S1. The skew mechanism lock nut is used to lock the entire skew mechanism in a particular position. In a second step, wrench R is used to loosen a skew adjustment rod lock nut LN, by rotation in a direction S2. The lock nut LN is used to secure a skew adjustment rod RS in a particular position. In a third step, wrench R is used to rotate the skew adjustment rod about its longitudinal axis, in a direction S3 (direction S3 is shown, for representation purposes, in a different plane in FIG. 3*c*). Rotation of skew adjustment rod RS about its longitudinal axis moves the pan roll PN angularly around slip roll SL. As is known in the art, the pan roll PN is pivotally mounted on a bracket for angular movement relative to slip roll SL. The skew adjustment rod RS has a bolt head BH upon which wrench R is mounted to rotate skew adjustment rod RS, and rotation of skew adjustment rod RS, in cooperation with threads on skew adjustment rod RS adjusts the skew adjustment rod RS in and out, to thereby move the skew or pan roll PN to an appropriate skew position. Finally, the wrench R is used to tighten the skew adjustment rod lock nut LN and the skew mechanism lock nut, in steps S4, S5, to lock the skew mechanism in its newly adjusted position. These adjustment steps are required for each upper and lower dampener UD, LD in each printing unit.

SUMMARY OF THE INVENTION

The apparatuses and methods for adjusting dampener skewing in prior art web-fed offset printing presses entail a number of different steps which must be manually made by the press operator, which can result in a time-consuming process each time that the width of the web is changed, or any other time that adjustment of the skewing of the dampener is required. Because of the time necessary to make the appropriate steps and adjustments to change the skew every time the width of a web is changed, operators frequently do not make the proper skew adjustment. As a result, too much or not enough water is transferred to the new web, which can result in poor printing quality or web breakage.

It is desirable to reduce the amount of time required for adjusting skew in the dampeners in a web-fed offset printing press to thereby reduce press down-time, or the chance that adjustments will not be made and an improper amount of water transferred to the web. The present invention is a method and apparatus which significantly simplifies and speeds up the process of adjusting dampener skewing in a web-fed offset printing press, or any other press. As a result, the present invention reduces down time and simplifies adjustment, such that the operator will be more likely to make the proper adjustment so that an appropriate amount of water is transferred to the web.

In the method and apparatus of the present invention one or more skew adjustment linkages connect skew adjustment rods for the upper and lower dampeners of each printing unit. The linkage ensures that a single movement by the operator will allow adjustment of the skewing of both the upper and lower dampeners at the same time. The linkage or linkages are preferably connected at one end to skew adjustment brackets, which in turn are connected to a skew adjustment rod for one of the upper or lower dampeners. The skew adjustment rod adjusts the amount of skew of an associated pan roll. In this manner, movement of the linkage controls the skew of both the upper and lower dampener pan rolls simultaneously.

Movement of the linkage may be controlled by movement of a spring plunger bracket, which is connected to the linkage or linkages. A spring plunger on the spring plunger bracket may be spring biased, and may be adjusted and locked into different skew setting positions using a pin-hole arrangement. A web width indicator associated with the spring plunger bracket may be used to guide the operator to an appropriate skew setting for a particular web width. The skew adjustment mechanism may also include a fine tuning mechanism, used to make minor adjustments to the skew settings for the dampeners, for example, when a particular setting is between one of the settings established by the pin-hole arrangement. This fine tuning mechanism can either individually or simultaneously allow fine tuning adjustment of the skew setting.

BRIEF DESCRIPTION OF THE DRAWING

The foregoing and other features of the present invention will become apparent to those skilled in the art to which the present invention relates from reading the following description with reference to the accompanying drawings, in which.

DETAILED DESCRIPTION OF THE INVENTION

Figure 1:
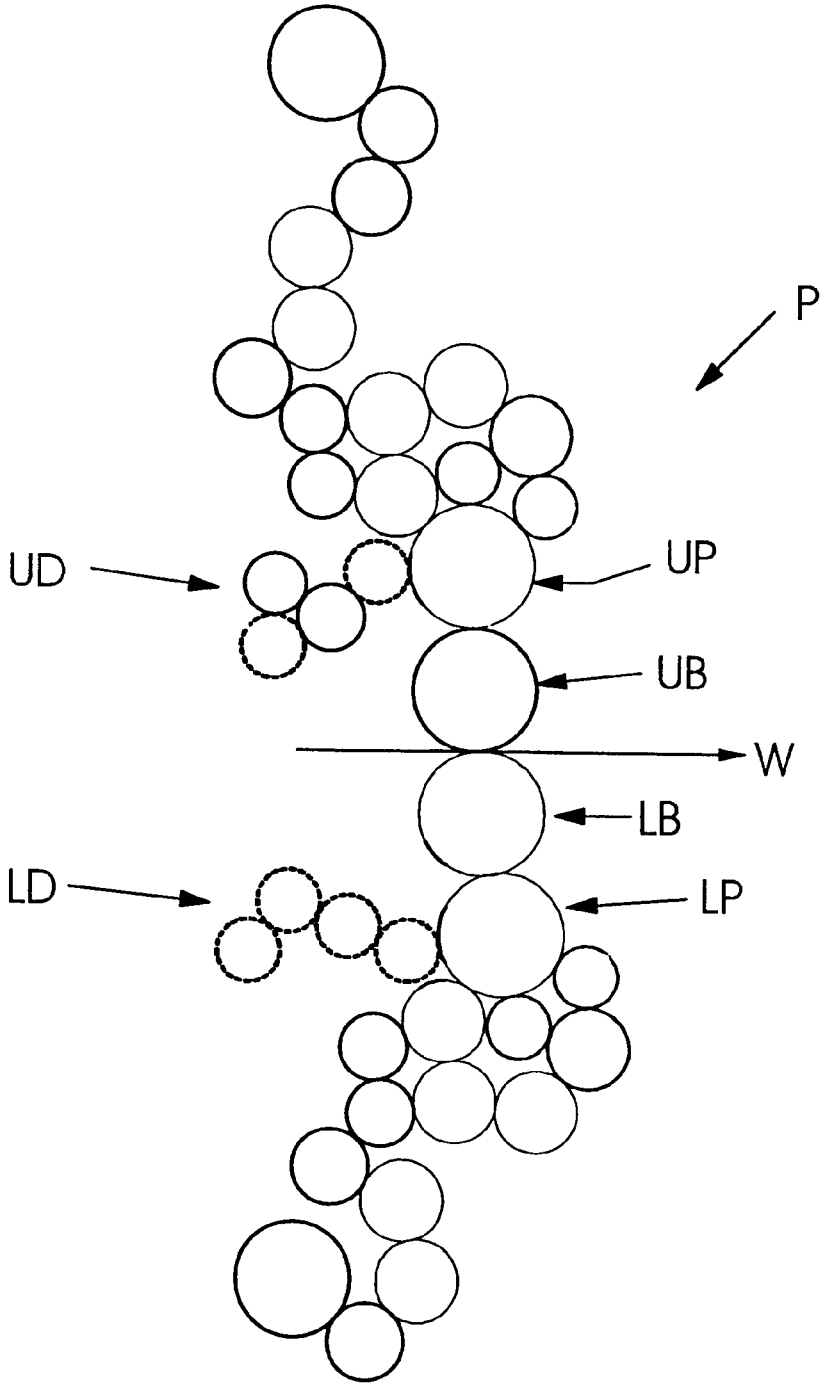
Fig.1 Prior Art
FIG. 1 is a schematic elevation view of a prior art printing press including upper and lower dampeners.
Figure 2A:
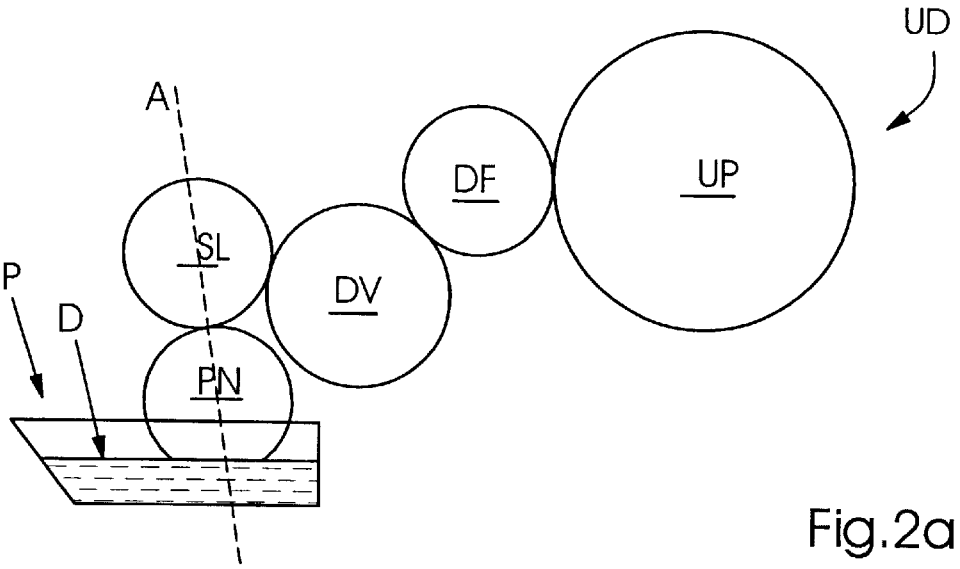
Fig.2a Prior Art
FIGS. 2*a* and 2*b* are schematic elevation views of prior art dampeners.
Figure 2B:
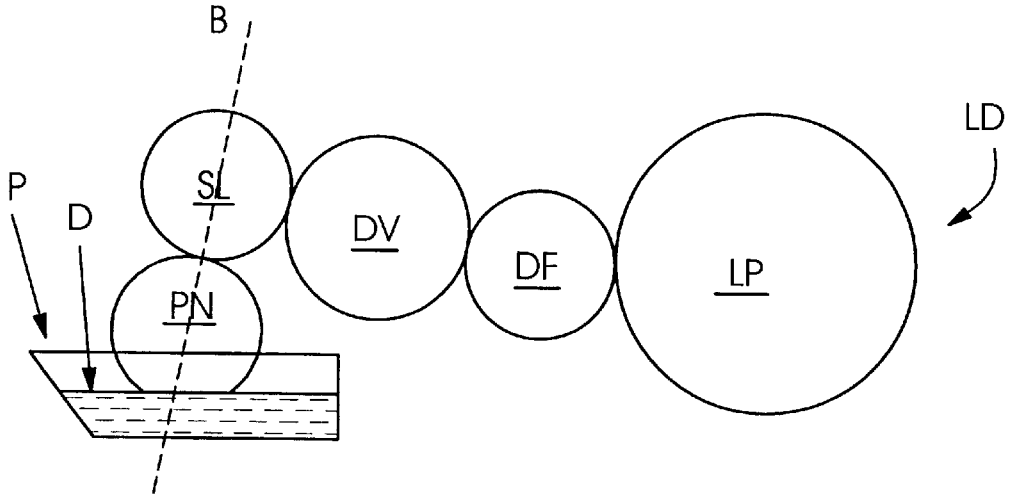
Fig.2b Prior Art
Figure 3A:
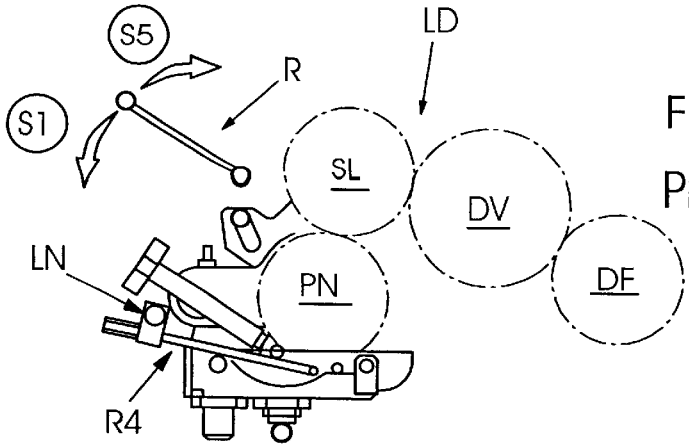
Fig.3a Prior Art
FIGS. 3*a*–3*d* are schematic elevation views of a prior art dampener, illustrating the steps necessary for skew adjustment.
Figure 3B:
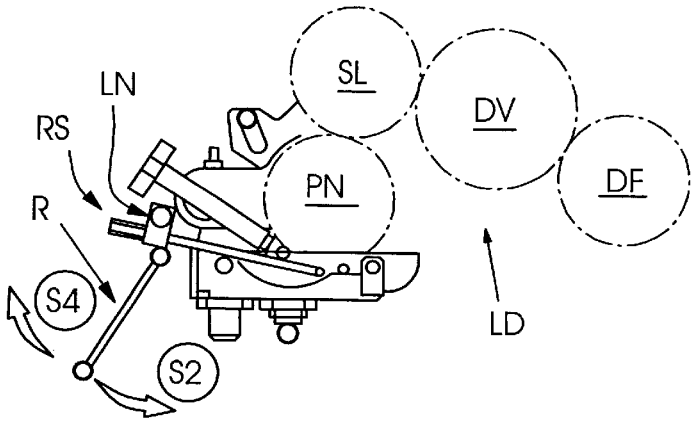
Fig.3b Prior Art
Figure 3C:
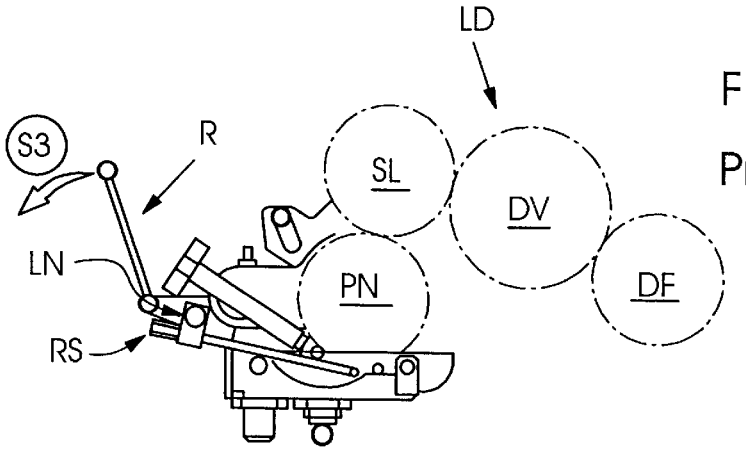
Fig.3c Prior Art
Figure 3D:
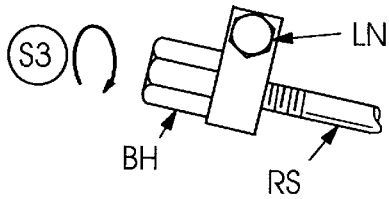
Fig.3d Prior Art
Figure 4:
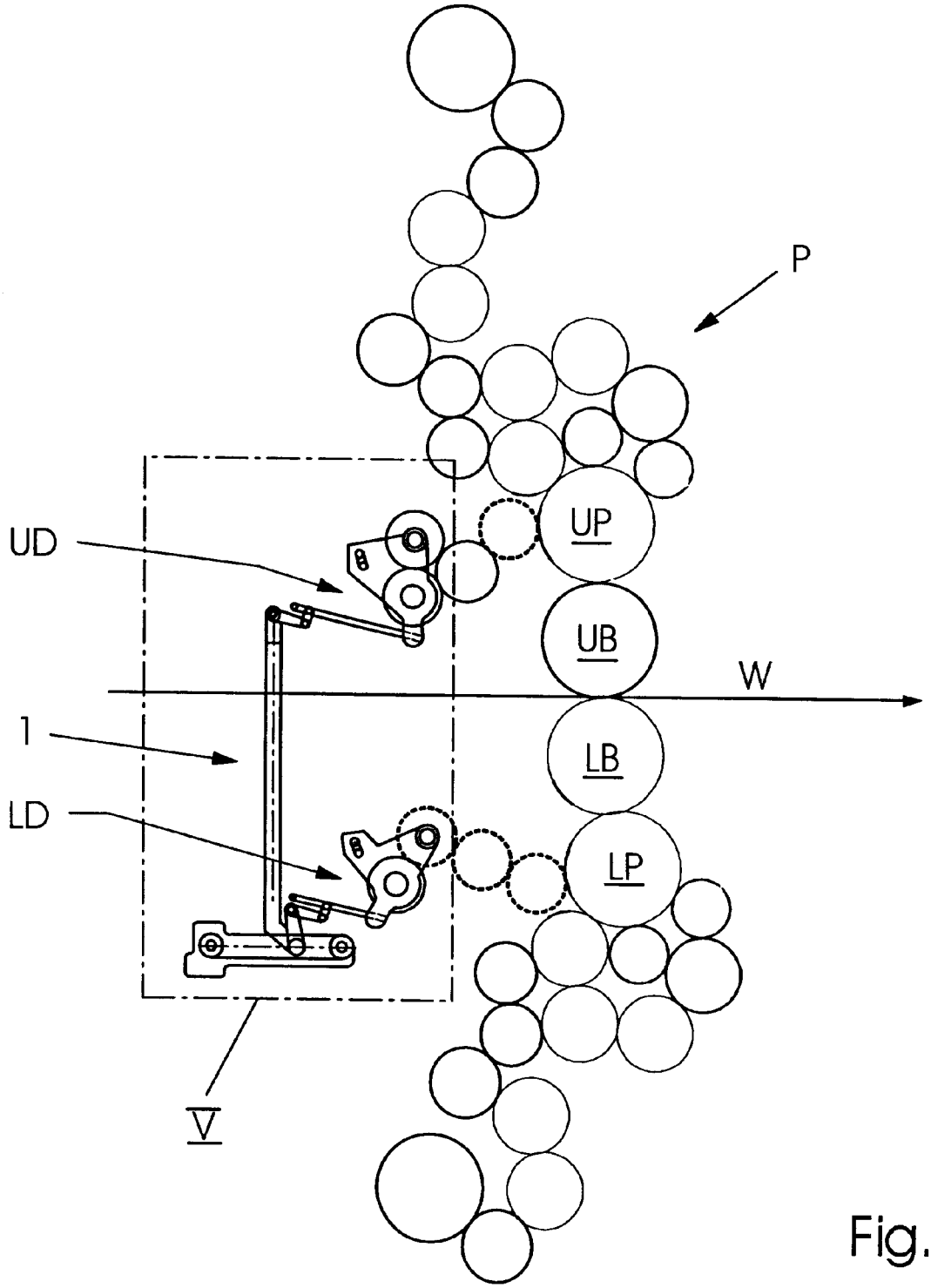
FIG. 4 is a schematic elevation view of a printing press incorporating the skew adjustment apparatus of the present invention.
Figure 5:
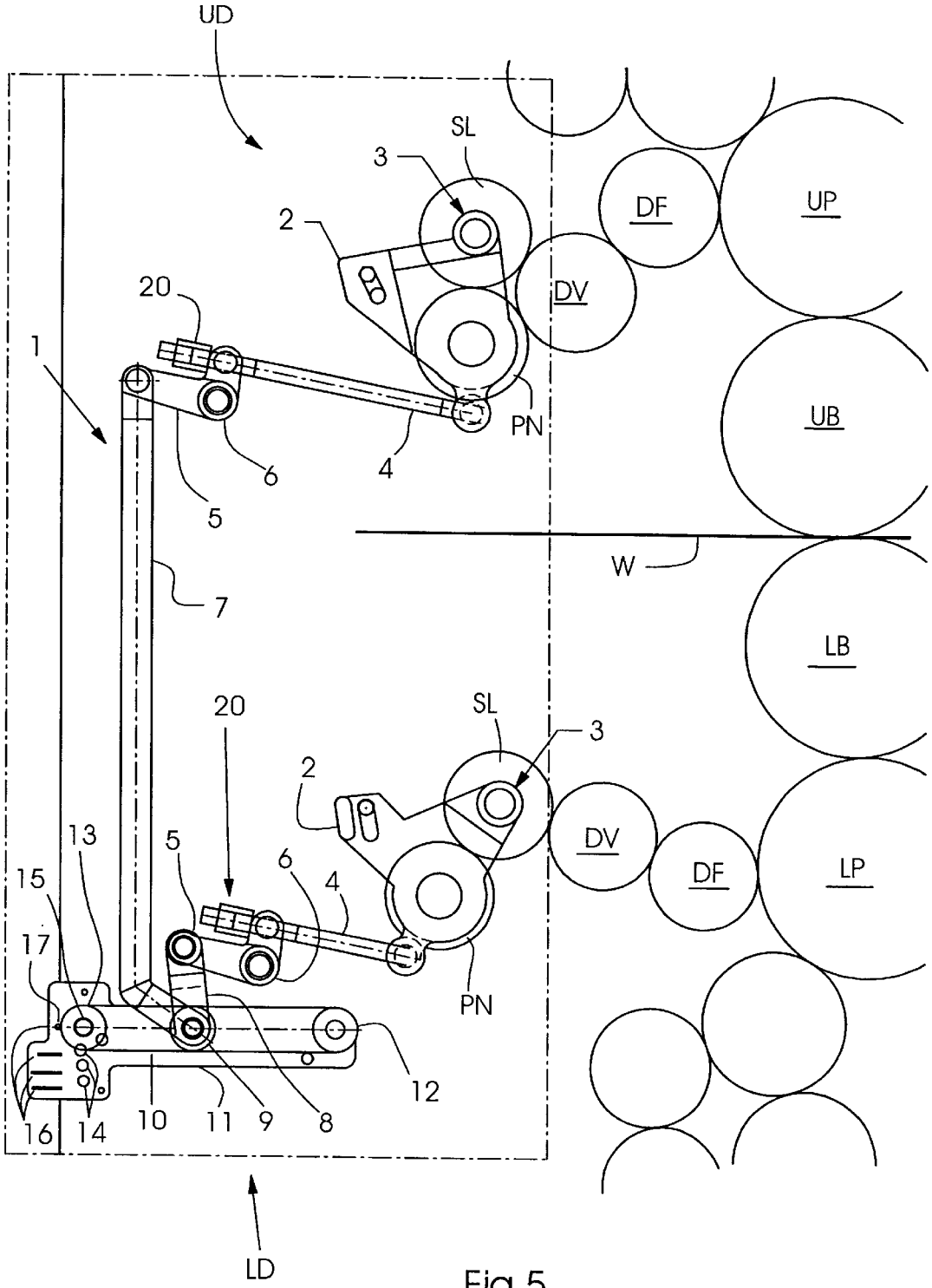
FIG. 5 is a detail elevation view of a first embodiment of the skew adjustment apparatus of the present invention.

FIG. 4 shows an overall schematic representation of the skew adjustment mechanism 1 of the present invention, used in a web-fed offset printing press unit P which prints on both sides of a web W using upper and lower plates UP, LP and upper and lower blankets UB, LB. A detailed view of the skew adjustment mechanism 1 of FIG. 4 is shown in FIG. 5. As in the prior art, the skew or pan rolls PN are mounted for angular adjustment relative to slip rolls SL. The skew or pan rolls PN have one end mounted on skew adjustment brackets 2, which pivot about skew pivot points 3, thereby allowing angular adjustment of the skew or pan rolls PN. The slip rolls SL transfer a dampening fluid, preferably water (with fountain solution), to vibrating rolls DV, then form rolls DF and then to either upper or lower plate UP, LP.

An end of skew adjustment brackets 2 opposite the skew pivot points 3 is pivotally connected to skew adjustment rods 4. The skew adjustment rods 4 are also pivotally connected to one end of skew adjustment rod brackets 5, which skew adjustment rod brackets 5 are pivotally mounted on a pivot point 6. The other end of skew adjustment rod brackets 5 are pivotally connected to upper and lower skew adjustment linkages 7, 8. The upper and lower skew adjustment linkages 7, 8 are pivotally connected to a spring plunger bracket 10 at a common pivot point 9. The spring plunger bracket 10 acts as an adjustment element for upper and lower skew adjustment linkages 7, 8. Spring plunger bracket 10 is pivotally mounted in a fixed bracket 11 at a spring plunger bracket pivot point 12. Spring plunger bracket 10 can include a spring plunger formed by a handle 13—used by an operator to pivot spring plunger bracket 10 about spring plunger bracket pivot point 12—a spring (not shown), and a pin 15.

Fixed bracket 11 can include a series of retention holes 14 along an arc defined by the pivoting of the spring plunger bracket 10. A pin 15 located on spring plunger fits into one of the retention holes 14, to thereby fix the position of the spring plunger bracket 10, and as a result, the skew position of the skew or pan rolls PN. An appropriate spring (not shown) can be used to bias the pin 15 of the spring plunger in the direction of the fixed bracket 11 and the appropriate retention hole 14. The handle 13 may be used by the operator to pull the pin 15, against the bias of the spring, out of engagement with one of the holes 14. A series of marks or indicia 16 located on fixed bracket 11 can indicate the particular widths of a web which correspond to the positions of the spring plunger bracket 10 when pin 15 is in each of the retention holes 14. An arrow or pointer 17 on the spring plunger bracket 10 can be used to align the spring plunger bracket 10 with one of the indicia 16 to thereby indicate an appropriate position for the spring plunger bracket 10 for a particular web width.

As will be understood, at times it may be necessary to make fine adjustments of the skew of the skew or pan rolls PN beyond the adjustments available by moving the spring plunger 10 between the position of retention holes 14. Therefore, the skew adjustment rods 4 of the present invention can include on one end a fine tuning bolt head 20. Fine tuning bolt head 20 may be turned by an appropriate wrench (not shown), to thereby turn threads on skew adjustment rods 4 and adjust the position of the skew adjustment rods 4 back and forth. As a result of this movement, the skew of the skew or pan rolls PN may be adjusted in small increments or in increments between the increments which are adjusted by moving the spring plunger 10 between retention holes 14. This arrangement is similar to the prior art skew adjustment rod RS shown in FIGS. 3*a*–3*d*.

Figure 5A:
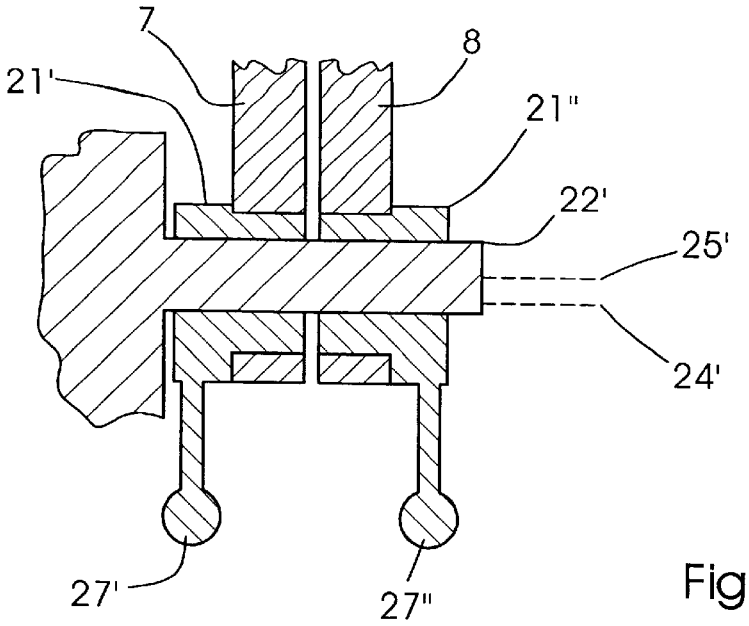
FIG. 5*a* is a detail cross-sectional view of a second embodiment of a fine adjustment mechanism of the present invention.
Figure 5B:
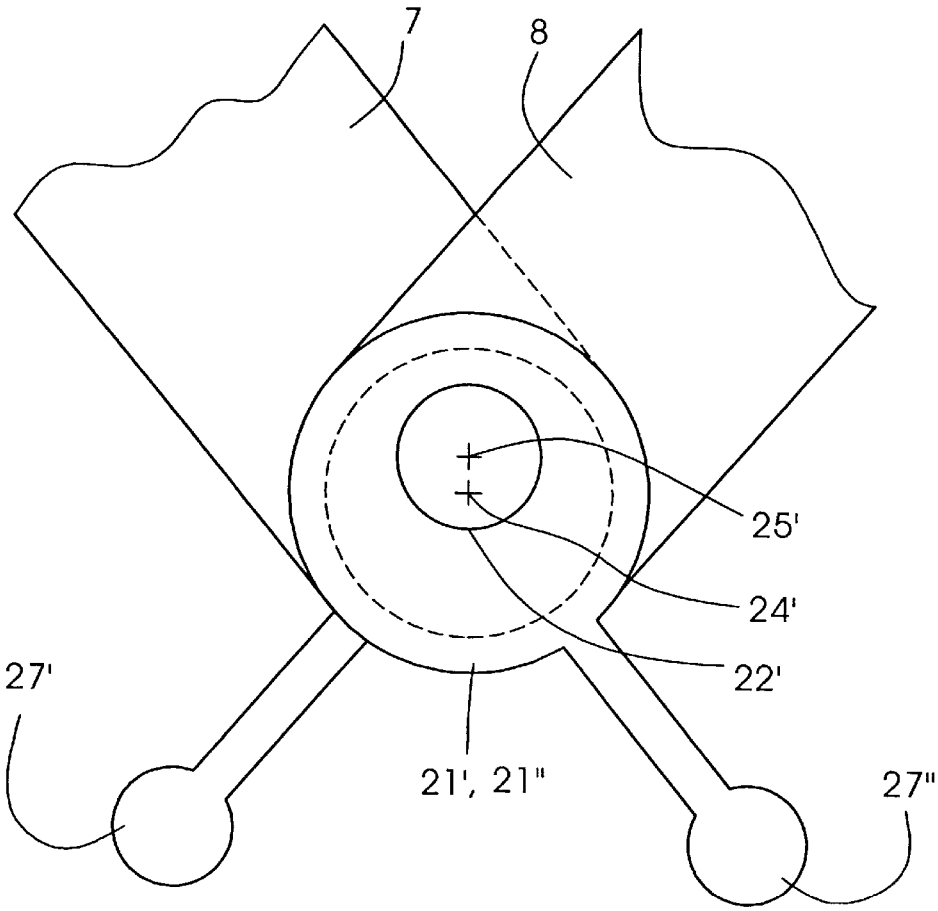
FIG. 5*b* is a detail elevation view of the embodiment of FIG. 5*a;*

In an alternative embodiment of the fine tuning mechanism, which is shown in FIGS. 5*a* and 5*b,* eccentric bushings 21', 21" are fixed to the upper and lower skew adjustment linkages 7, 8, respectively, at the common pivot point 9. The eccentric bushings 21', 21" have a center point 24' which is offset from a center point 25' of a fixed shaft 22' upon which are mounted the eccentric bushings 21', 21". The upper and lower skew adjustment linkages 7, 8 are fixed to the eccentric bushings 21', 21", respectively, and rotate with the eccentric bushings 21', 21" about shaft 22. Handles 27', 27" connected to the eccentric bushings 21', 21", respectively, are used by an operator to rotate the eccentric bushings 21', 21" and thus the upper and lower skew adjustment linkages 7, 8. In order to provide fine tuning adjustment in the embodiment of FIGS. 5*a* and 5*b,* the operator would turn the handles 27', 27", which rotates eccentric bushings 21', 21", thereby moving the upper and lower skew adjustment linkages 7, 8; respectively. This arrangement allows for separate fine tuning adjustments of the upper and lower skew or pan rolls PN.

Figure 5C:
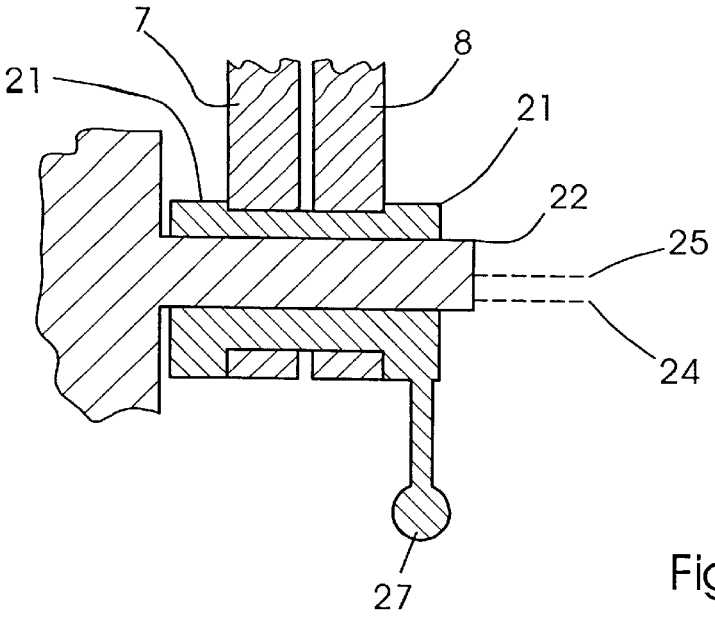
FIG. 5*c* is a detail cross-sectional view of a third embodiment of a fine adjustment mechanism of the present invention.
Figure 5D:
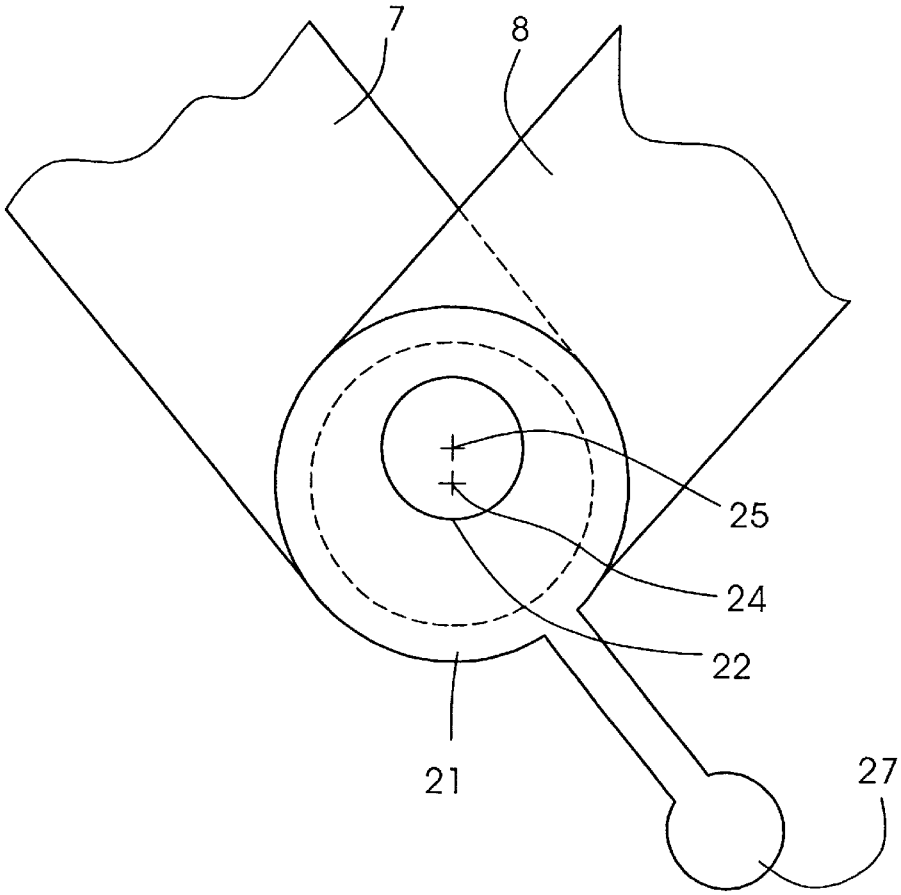
FIG. 5*d* is a detail elevation view of the embodiment of FIG. 5*c;*

An alternative embodiment of the fine tuning mechanism shown in FIGS. 5*a* and 5*b,* is shown in FIGS. 5*c* and 5*d,* which allows simultaneous fine tuning adjustments of the upper and lower skew adjustment linkages 7, 8. In the embodiment of FIGS. 5*c* and 5*d,* a single eccentric bushing 21 is used, which is fixed to both the upper and lower skew adjustment linkages 7, 8 at the common pivot point 9. The eccentric bushing 21 has a center point 24 which is offset from a center point 25 of fixed shaft 22 upon which is mounted the eccentric bushing 21. The upper and lower skew adjustment linkages 7, 8 are fixed to the eccentric bushing 21 and simultaneously rotate with the eccentric bushing 21 about shaft 22. A handle 27 connected to the eccentric bushing 21 is used by an operator to rotate the eccentric bushing 21 and thus the upper and lower skew adjustment linkages 7, 8 simultaneously. In order to provide simultaneous fine tuning adjustment in the embodiment of FIGS. 5*c* and 5*d,* the operator would turn the handle 27, which rotates eccentric bushing 21, thereby moving the upper and lower skew adjustment linkages 7, 8, simultaneously. This arrangement allows for simultaneous fine tuning adjustments of the upper and lower skew or pan rolls PN with a single operator adjustment.

Figure 6:
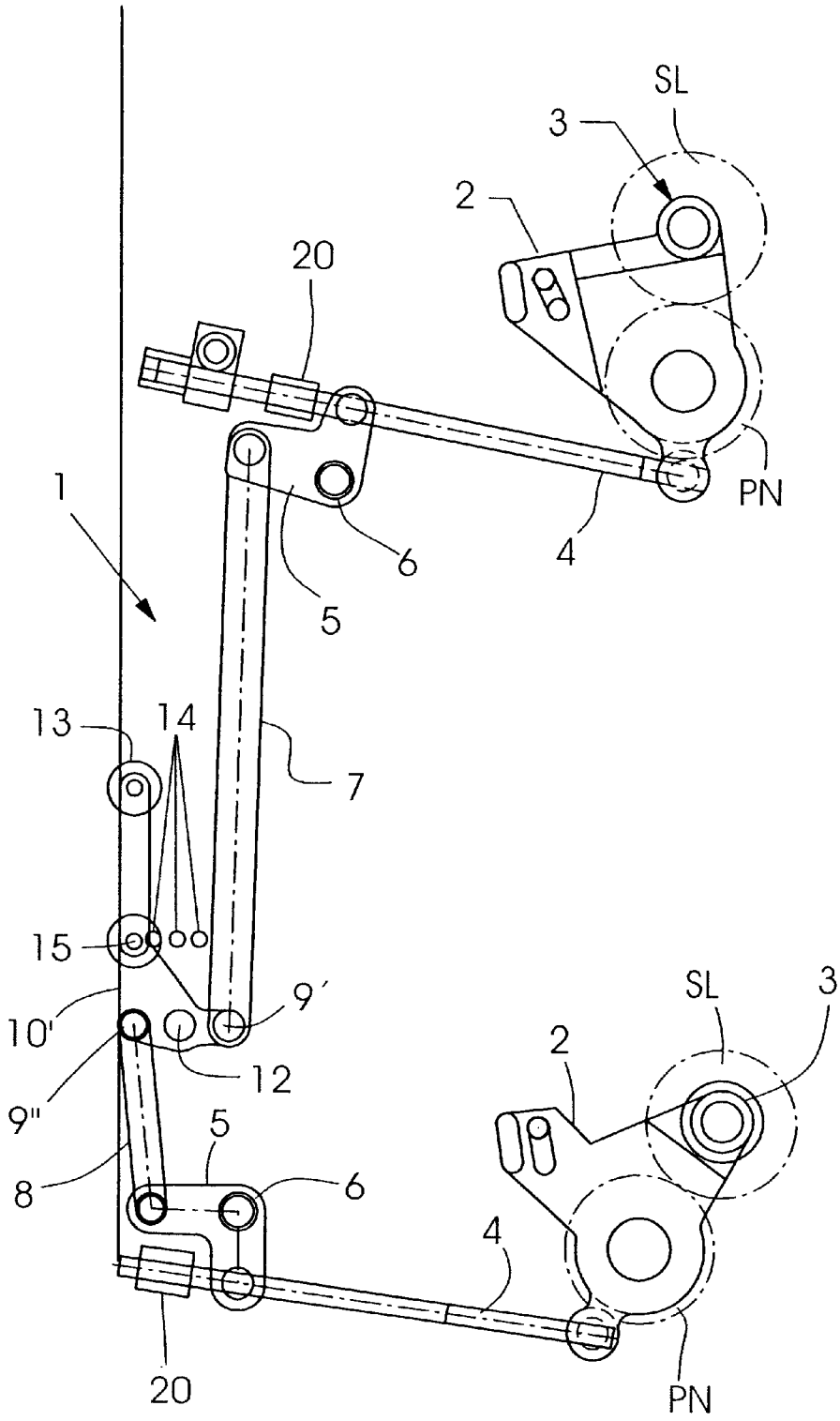
FIG. 6 is a detail elevation view of a second embodiment of the skew adjustment apparatus of the present invention.

FIG. 6 shows an alternative embodiment of the skew adjustment mechanism 1' of the present invention. The embodiment of FIG. 6 is similar to the embodiment of FIG. 5, except that in the embodiment of FIG. 6, the spring plunger bracket 10' is mounted vertically, not horizontally, the upper and lower skew adjustment linkages 7, 8 are connected to the spring plunger bracket 10' at spaced pivot points 9', 9", and the pin 15 is located at a different position on the spring plunger bracket 10'. In all other respects, however, the structure and operation of the embodiments of FIGS. 5 and 6 are the same.

In the method of adjustment according to the present invention, the operator of the press P would first stop the press and feed a web W of a new width through the press P. Thereafter, the operator would select an appropriate skew setting by pulling the spring plunger out so that the pin 15 is removed from a retention hole 14 (against the bias of a spring), and pivoting the spring plunger bracket 10 or 10' about pivot point 12 to a position at which the arrow or pointer 17 on the spring plunger bracket 10 or 10' is aligned with an appropriate A indicia 16 for the web width being used. The pin 15 is thereby aligned with the appropriate retention hole 14. The operator thereafter releases the spring plunger, and the pin 15 enters the appropriate retention hole 14 under the action of spring bias. During movement of the spring plunger bracket 10 or 10' about pivot point 12, the upper and lower skew adjustment linkages 7, 8 are simultaneously moved, which results in a corresponding simultaneous pivoting movement of skew adjustment rod brackets 5, and a corresponding simultaneous linear movement of skew adjustment rods 4. The simultaneous linear movement of skew adjustment rods 4 causes simultaneous skew adjustment of skew or pan rolls PN.

If fine tuning adjustment of the skew or pan rolls PN is desired, in the embodiments of FIGS. 5 and 6, the operator would use a wrench or another appropriate tool to turn fine tuning bolt head 20 for each skew adjustment rod 4, thereby causing linear movement of each skew adjustment rod 4, and a resulting skew adjustment of the associated skew or pan roll PN. This fine tuning adjustment could be used to adjust the skew of the skew or pan rolls PN for web widths not provided for using the settings of the retention holes 14, or could be used to fine tune the skew settings of the skew or pan rolls PN corresponding to the retention holes 14. For fine tuning using the fine tuning adjustment mechanism of FIG. 5*c* and 5*d,* the operator would use a handle 27, thereby causing simultaneous movement of upper and lower skew adjustment linkages 7, 8, which results in a corresponding simultaneous pivoting movement of skew adjustment rod brackets 5, and a corresponding simultaneous linear movement of skew adjustment rods 4. The simultaneous linear movement of skew adjustment rods 4 causes simultaneous skew adjustment of skew or pan rolls PN. This fine tuning adjustment could be used to simultaneously adjust the skew of the skew or pan rolls PN for web widths not provided for using the settings of the retention holes 14, or could be used to fine tune the skew settings of the skew or pan rolls PN corresponding to the retention holes 14. In the embodiment of FIGS. 5*a* and 5*b,* the operator would turn the handles 27' or 27" to rotate bushings 21' or 21" about shaft 22', thereby causing movement of upper or lower skew adjustment linkages 7, 8, respectively, which results in a corresponding pivoting movement of one of the skew adjustment rod brackets 5 and a corresponding linear movement of one of the skew adjustment rods 4.

In the above description of the invention, those skilled in the art will perceive improvements, changes and modifications. Improvements, changes and modifications within the skill of the art are intended to be covered by the claims.

What is claimed is:

1. A dampener skew adjustment mechanism for a printing press, comprising:

an upper dampener roll, the upper dampener roll transferring water to an upper plate;

a lower dampener roll, the lower dampener roll transferring water to a lower plate;

upper and lower skew adjustment brackets, the upper and lower skew adjustment brackets being pivotally mounted, the upper dampener roll being mounted on the upper skew adjustment bracket and the lower dampener roll being mounted on the lower skew adjustment bracket; and at least one linkage, the at least one linkage being connected to both the upper and lower skew adjustment brackets, movement of the at least one linkage simultaneously moving both the upper and lower skew adjustment brackets.

2. The adjustment mechanism of claim 1, wherein:

the at least one linkage includes an upper skew adjustment linkage and a lower skew adjustment linkage.

3. The dampener skew adjustment mechanism of claim 2, further comprising:

an adjustment element, the upper and lower skew adjustment linkages are both pivotally connected to the adjustment element.

4. The adjustment mechanism of claim 1, further comprising:

an adjustment element connected to the at least one linkage, the adjustment element moving the at least one linkage.

5. The dampener skew adjustment mechanism of claim 4, wherein:

the adjustment element is a pivotally mounted bracket.

6. The dampener skew adjustment mechanism of claim 5, wherein:

the at least one linkage is pivotally connected to the pivotally mounted bracket.

7. The dampener skew adjustment mechanism of claim 4, wherein:

the at least one linkage is pivotally connected to the adjustment element.

8. A dampener skew adjustment mechanism for a printing press, comprising:

an upper dampener roll and a lower dampener roll;

upper and lower skew adjustment brackets, the upper and lower skew adjustment brackets being pivotally mounted, the upper dampener roll being mounted on the upper skew adjustment bracket and the lower dampener roll being mounted on the lower skew adjustment bracket; and at least one linkage, the at least one linkage being connected to both the upper and lower skew adjustment brackets, movement of the at least one linkage simultaneously moving both the upper and lower skew adjustment brackets;

an adjustment element connected to the at least one linkage, the adjustment element moving the at least one linkage, the adjustment element being a pivotally mounted bracket: and a spring plunger mounted on the pivotally mounted bracket.

9. The dampener skew adjustment mechanism of claim 8, further comprising:

a plurality of holes, the spring plunger fitting into one of the plurality of holes to fix a position of the bracket.

10. A dampener skew adjustment mechanism for a printing press, comprising:

an upper dampener roll and a lower dampener roll;

upper and lower skew adjustment brackets, the upper and lower skew adjustment brackets being pivotally mounted, the upper dampener roll being mounted on the upper skew adjustment bracket and the lower dampener roll being mounted on the lower skew adjustment bracket;

at least one linkage, the at least one linkage being connected to both the upper and lower skew adjustment brackets, movement of the at least one linkage simultaneously moving both the upper and lower skew adjustment brackets; and first and second skew adjustment rods, the first skew adjustment rod being connected to the at least one linkage and the first skew adjustment bracket, the second skew adjustment rod being connected to the at least one linkage and the second skew adjustment bracket.

11. The dampener skew adjustment mechanism of claim 10, further comprising:

first and second fine tuning bolt heads mounted on the first and second skew adjustment rods, respectively.

12. A dampener skew adjustment mechanism for a printing press, comprising:

an upper dampener roll and a lower dampener roll;

upper and lower skew adjustment brackets, the upper and lower skew adjustment brackets being pivotally mounted, the upper dampener roll being mounted on the upper skew adjustment bracket and the lower dampener roll being mounted on the lower skew adjustment bracket;

at least one linkage, the at least one linkage being connected to both the upper and lower skew adjustment brackets, movement of the at least one linkage simultaneously moving both the upper and lower skew adjustment brackets; and an adjustment element connected to the at least one linkage, the adjustment element moving the at least one linkage; and at least one eccentric bushing, the at least one eccentric bushing being connected between the at least one linkage and the adjustment element, the at least one eccentric bushing adjusting the at least one linkage relative to the adjustment element

13. A dampener skew adjustment mechanism for a printing press, comprising:

an upper dampener roll and a lower dampener roll;

upper and lower skew adjustment brackets, the upper and lower skew adjustment brackets being pivotally mounted, the upper dampener roll being mounted on the upper skew adjustment bracket and the lower dampener roll being mounted on the lower skew adjustment bracket, at least one linkage, the at least one linkage being connected to both the upper and lower skew adjustment brackets, movement of the at least one linkage simultaneously moving both the upper and lower skew adjustment brackets, the at least one linkage including an upper skew adjustment linkage and a lower skew adjustment linkage;

an adjustment element; and at least one eccentric bushing, the at least one eccentric bushing being connected between the upper and lower skew adjustment linkages and the adjustment element, the at least one eccentric bushing adjusting the upper and lower skew adjustment linkages relative to the adjustment element

14. A dampener skew adjustment mechanism for a printing press comprising:

an upper dampener roll and a lower dampener roll;

upper and lower skew adjustment brackets, the upper and lower skew adjustment brackets being pivotally mounted, the upper dampener roll being mounted on the upper skew adjustment bracket and the lower dampener roll being mounted on the lower skew adjustment bracket;

at least one linkage, the at least one linkage being connected to both the upper and lower skew adjustment brackets, movement of the at least one linkage simultaneously moving both the upper and lower skew adjustment brackets, the at least one linkage including an upper skew adjustment linkage and a lower skew adjustment linkage;

an adjustment element; and a first and a second eccentric bushing, the first eccentric bushing being connected between the upper skew adjustment linkage and the adjustment element, the second eccentric bushing being connected between the lower skew adjustment linkage and the adjustment element, the eccentric bushings adjusting the upper and lower skew adjustment linkages relative to the adjustment element.

* * * * *